US006409501B1

(12) United States Patent
Pappas

(10) Patent No.: US 6,409,501 B1
(45) **Date of Patent: *Jun. 25, 2002**

(54) CANDLE WITH SURROUNDING DECORATIVE COMBUSTIBLE MATERIAL

(75) Inventor: George G. Pappas, Norwich, OH (US)

(73) Assignee: Lumi-Lite Candle Company, Inc., Norwich, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/327,030

(22) Filed: Jun. 7, 1999

Related U.S. Application Data

(63) Continuation-in-part of application No. 09/099,539, filed on Jun. 18, 1998, now Pat. No. 5,927,965.

(51) Int. Cl.[7] ..... F23D 3/16

(52) U.S. Cl. ..... 431/289; 431/288; 264/247; 264/259; 425/803

(58) Field of Search ..... 431/289, 288, 431/291, 196, 297; 264/247, 259, 279.1; 425/803

(56) References Cited

U.S. PATENT DOCUMENTS

| | | | | | |
|---|---|---|---|---|---|
| 35,154 | A | * | 5/1862 | Houchin | 431/291 |
| 43,628 | A | * | 7/1864 | Daire | 431/297 |
| 574,376 | A | * | 1/1897 | Baumer | 431/291 |
| 1,267,968 | A | * | 5/1918 | Bulle | 431/291 |
| 1,945,953 | A | * | 2/1934 | O'Connell | 431/291 |
| 2,122,451 | A | | 7/1938 | Cassimatis | |
| D111,775 | S | | 10/1938 | Seaver | |
| 2,240,071 | A | * | 4/1941 | Gisolfi | 431/291 |
| 2,315,803 | A | * | 4/1943 | Lipari | 40/620 |
| 2,354,343 | A | * | 7/1944 | Webber et al. | 431/289 |
| D173,759 | S | | 12/1954 | Kranz | |
| RE24,423 | E | * | 7/1955 | Oesterle et al. | 431/291 |
| D178,200 | S | | 7/1956 | McKenzie et al. | |
| 2,817,225 | A | | 12/1957 | Weglin | |
| 3,175,876 | A | | 3/1965 | Fredericks | |
| 3,428,409 | A | * | 2/1969 | Summers | 431/289 |
| 3,462,235 | A | * | 8/1969 | Summers | 431/289 |
| 3,466,135 | A | * | 9/1969 | Summers | 431/297 |
| 3,741,711 | A | * | 6/1973 | Bryant | 431/291 |
| 3,983,677 | A | | 10/1976 | Lundbom | |
| 4,225,552 | A | | 9/1980 | Chang | |
| 4,524,408 | A | * | 6/1985 | Minera | 431/291 |
| 4,555,231 | A | * | 11/1985 | Kustka | 431/288 |
| 4,568,270 | A | | 2/1986 | Marcus et al. | |
| 4,696,640 | A | | 9/1987 | Pitchford | |
| 4,759,699 | A | * | 7/1988 | Rubarth | 431/291 |
| 4,815,967 | A | * | 3/1989 | Sullivan et al. | 431/297 |
| 4,826,428 | A | | 5/1989 | Lam | |
| 4,895,512 | A | * | 1/1990 | Sullivan et al. | 431/297 |
| 5,395,233 | A | | 3/1995 | Karp | |
| D370,067 | S | | 5/1996 | Osland et al. | |
| 5,597,300 | A | * | 1/1997 | Wohl et al. | 431/289 |
| 5,651,669 | A | * | 7/1997 | Henry | 431/289 |
| 5,697,694 | A | * | 12/1997 | Cutts | 431/291 |
| 5,840,246 | A | * | 11/1998 | Hammons et al. | 422/4 |
| 5,891,400 | A | * | 4/1999 | Ansari et al. | 422/125 |
| 5,927,964 | A | * | 7/1999 | Fawcett | 431/289 |
| 6,036,477 | A | * | 3/2000 | Frandsen | 431/289 |
| 6,059,564 | A | * | 5/2000 | Morris | 431/291 |

FOREIGN PATENT DOCUMENTS

| | | | | |
|---|---|---|---|---|
| GB | 190257 | * | 12/1922 | 431/289 |

* cited by examiner

*Primary Examiner*—James C Yeung
(74) *Attorney, Agent, or Firm*—Frank H. Foster; Kremblas, Foster, Phillips & Pollick

(57) ABSTRACT

A candle and method of making the candle. The candle includes a core surrounded by a combustible material and a fill composition. The combustible material surrounds the core. A wick extends downwardly a selected distance from the top of the core. The core is partly surrounded by a translucent sleeve which may include holes. In this way, the risk of the combustible material catching fire is reduced.

19 Claims, 8 Drawing Sheets

CANDLE WITH SURROUNDING DECORATIVE COMBUSTIBLE MATERIAL

CROSS-REFERENCES TO RELATED APPLICATIONS

This application is a continuation-in-part of application Ser. No. 09/099,539 filed Jun. 18, 1998, now U.S. Pat. No 5,927,965.

BACKGROUND OF THE INVENTION

1. Field of the Invention

The present invention relates generally to decorative candles and more specifically to candles which include a decorative, combustible material.

2. Description of the Related Art

In the past, it has been desirable to decorate candles with a variety of materials to add a texture, scent, or additional decorative features. Candles have been decorated with stones, potpourri, and a variety of other particulate materials, such as cocoa powder. Other types of decorations which have been desirable have included messages on paper and the like. Many of these materials can catch fire when exposed to a flaming wick. Examples of references which disclose the desirability of including these types of materials are the patents to Cassimatis, U.S. Pat. No. 2,122,451; Weglin, U.S. Pat. No. 2,817,225; Frederics, U.S. Pat. No. 3,175,876; Lundbom, U.S. Pat. No. 3,983,677; Pitchford, U.S. Pat. No. 4,696,640; and Karp, U.S. Pat. No. 5,395,233, as well as the design patents to Seaver, U.S. Design Pat. No. 111,775; McKenzie et al., U.S. Design Pat. No. 178,200; Kranz, U.S. Design Pat. No. 173,759; and Osland et al., U.S. Design Pat. No. 370,067.

A problem which has been found when this type of material is used in a candle is that the decorative, combustible material added to the candle can come into contact with the flame when the candle is burning, thereby causing a fire. Of particular note is the problem that wax or other fuel which is used to make the candle can melt away from the combustible material, allowing the combustible material to fall into the pool of molten fuel which is near the flame. When this occurs, the combustible material can fall into or float to a position near the flame and either catch fire or become a secondary wick supporting an additional flame, which is undesirable and unsafe.

A possible, but impractical, solution to these problems would be to use candles that include this type of material only as decorative articles and not burn them. However, since a primary purpose of candles is to generate light, such a solution would be unacceptable to consumers.

Another possible solution is to cover the combustible material by a non-flammable shielding, such as was shown in the above-cited Pitchford disclosure. However, such a design would be unattractive in the majority of cases, as the non-flammable material would become exposed during the burning of the candle. Since candles have a decorative purpose, an unattractive candle is not a practical option.

Another option is to avoid combustible materials in a candle, such as was done by Lundbom. However, this solution is really not a solution at all, since it is desirable to use some combustible materials in a candle because of their aesthetic value.

Yet another option is to design the candle such that the wax does not burn to the edges, such as was shown in the above-cited patent to Karp. While this may be workable in some instances, it creates waste which is not desirable. In addition, a cylinder of wax surrounding the lit wick is not desirable and may cause the candle to burn improperly. The use of such a design can also create problems for a user who may be unable to light the candle once it burns down several inches.

A modification to this type of solution is found in some candles currently sold commercially. This modified configuration includes a translucent, non-combustible sleeve which is positioned in a candle between the core, which includes the wick and comprises the burnable portion of the candle, and an exterior layer which includes a combustible material combined with a fuel. However, this type of candle does not fully solve the flashover problem and is difficult to manufacture.

What is needed, therefore, is a candle which is designed such that a combustible material can be used as a decorative feature on a candle with a minimum risk of ignition while minimizing the probability of the flashover. The present invention minimizes that risk.

BRIEF SUMMARY OF THE INVENTION

The candle of the present invention solves these and other problems by separating the burning wick from the combustible material by the insertion of a sleeve and in one type of embodiment by raising one end of the wick above the base of the candle. The candle includes a fuel core including a wick which extends a selected distance downwardly from the top surface of the core. A protective sleeve, which is preferably translucent, surrounds the fuel core by extending substantially the selected distance from the top surface of the core. A combustible material surrounds at least a portion of the sleeve.

A fill composition, such as a candle fuel, is interspersed around the combustible material and secures the combustible material to the sleeve or core. The fill composition is a fluent material which, when poured around the decorative combustible material, at least partially surrounds or encases the decorative combustible material and preferably fills voids between pieces of decorative combustible material. The fill composition is not significantly fluent at normal candle operating temperatures. The fill composition may be candle wax or other candle fuel. Alternatively, it may be a non-flammable material or a flame-retardant material.

The core may be a short-wicked candle or alternatively may include a first portion which rests atop a second portion. The first portion is preferably a candle and the second portion is preferably a riser. The riser preferably takes the form of a block of wax. But, in some embodiments it may advantageously be a block of nonflammable material, such as glass, ceramic or metal. The sleeve preferably surrounds the first portion or candle and rests atop the second portion or riser.

The method of making the candle incorporates the use of a mold. The core is placed in a mold. The mold is sufficiently larger than the core that the core is spaced from the sides of the mold. The core includes a wick which extends a selected distance from a top surface of the core. A protective sleeve is then placed in surrounding relationship to the fuel core, and the protective sleeve extends and surrounds the fuel core substantially a selected distance from the top surface of the core. A decorative combustible material is then filled into the space between the sides of the mold and the core until at least a portion of the sleeve is surrounded with the combustible material. A fill composition is then poured into the space between the sides of the mold and the sleeve and core to intersperse the fill composition around the combustible material.

The step of placing the core in the mold may comprise placing a short-wicked candle in the mold. Alternatively, the step of placing the core in the mold may comprise placing a riser in the mold, then placing a candle on the riser. The riser may also be poured in place.

In an alternative embodiment, the candle includes a fuel core including a wick, a combustible material, and sleeve which substantially surrounds the fuel core and which is at least partially surrounded by the combustible material. The sleeve includes a plurality of holes which are impassable to the combustible material. The sleeve extends substantially from about a top surface of the fuel core to about the bottom surface of the fuel core. In one alternative embodiment, the wick extends only a selected distance from about the top surface of the fuel core. However, because the combustible material cannot pass through the holes in the sleeve, the wick may also extend substantially from about a top surface of the fuel core to about the bottom surface of the fuel core.

To make this embodiment of the candle, the sleeve, which has a plurality of holes therethrough, is placed in a mold, thereby separating the mold into inner and outer generally concentric portions. The combustible material is then poured into at least the outer portion. A fill composition is then poured into at least one of the portions of the mold and passes through the holes in the sleeve, thereby at least partially filling, and sometimes substantially filling, each of the portions. In one alternative method, a wick is suspended in the inner portion of the mold and the fill composition is poured into the inner portion. In a second alternative method, a core candle is placed within the sleeve before the fill composition is poured into the outer portion of the mold. The fill composition is then added, underfilling the inner portion of the mold beneath the core candle and substantially filling the outer portion of the mold. In a third alternative method, the fill composition is poured into one of the portions to partially fill each of the portions. This forms a riser in the bottom of the inner portion. Then a core candle is placed in the inner portion of the mold on top of the riser. Finally, an additional quantity of the fill composition is poured into the outer portion of the mold to substantially fill the outer portion.

In yet another embodiment, the candle includes a sleeve having a top and a bottom, and a fuel core substantially surrounded by the sleeve and extending into the sleeve a selected distance from the top of the sleeve. Because the selected distance is spaced from the bottom of the sleeve, a cavity is formed. The cavity may be filled with air or may be at least partially filled with a non-flammable solid, such as ceramic or glass. The candle may also include a base adjacent the bottom of the sleeve. A combustible material may surround at least a portion of the sleeve and a fill composition may be interspersed around the combustible material.

The use of this process and product will reduce the probability of any of the combustible material falling into the pool of molten wax which forms when this type of candle is lit. The flame and the molten wax will remain separated from the combustible material. In addition, the use of the riser tends to minimize the risk of flashover. Thereby, the risk of fire when this type of candle is used is greatly reduced.

Figure 1:
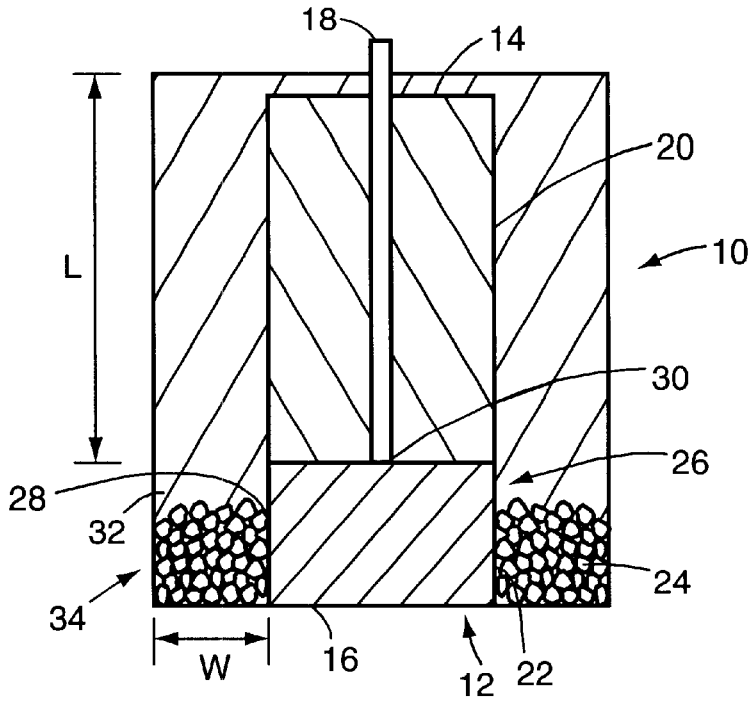
FIG. 1 is a cross-sectional view of a first embodiment of the candle of the present invention using a first embodiment of the core.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

The present invention relates to a candle and a method of making a candle which includes a combustible material surrounding a core. The product will be first described, then the method of making.

Referring most particularly to FIG. 1, a preferred embodiment of the candle 10 is shown. The candle 10 includes a cylindrical wax core 12. The core 12 includes a top 14 and a bottom 16. As is true of candles as a general matter, the top 14 is the surface of the candle 10 through which a wick 18 protrudes or extends for lighting by a user; and the bottom 16 is the surface of the candle 10 which rests on a surface (not shown) for display. The wick 18 is surrounded by the core 12 and extends a selected distance downwardly from the top 14 of the core 12 towards the bottom 16 of the core 12. The shape of the candle 10 as shown in the FIGS. is generally a circular cylinder. However, the shape of the candle 10 is not critical to the present invention and may be a square or oval cylinder or any other desirable shape.

The core 12 may include a number of parts. As shown in FIG. 1, the core 12 may be a candle 20 placed atop a riser 22. In the preferred embodiment, the riser 22 is a block of fuel, preferably wax. However, many alternatives to the block of fuel are possible. For example, a non-flammable solid, such as a metal, ceramic or glass block, can be used in the place of the block of wax. In addition, although the riser 22 is shown in many of the FIGS. as being the same shape and diameter as the candle 20, the riser 22 may be larger or smaller in diameter than the candle 20 or may differ in shape. It may be desirable to use a different shape for a number of reasons, including cost of production. Other possible modifications to the riser 22 will be described in connection with the method of making the candle 10 later in the present disclosure.

The core 12 is surrounded by a combustible material 24. In the embodiments shown in FIGS. 1–4, the combustible material 24 surrounds a lower part of the core 12, up to a selected level 28. The selected level 28 is spaced from the bottom 16 of the core 12. If, as is shown in FIG. 1, the combustible material 24 is a particulate matter, the selected level 28 is more difficult to define since the precise level of the combustible material 24 is not constant, due to the particulate nature or irregular shape of the material not allowing each particle to fall to the same height. However, the selected level 28 is defined as generally the point at which the uppermost particles of the combustible material 24 touch the core 12.

In this embodiment, the wick 18 extends downwardly from the top 14 of the core 12 no further than substantially the selected level 28. The terms "down" and "low" and their related forms refer to a direction towards the bottom 16 of the core 12, while the terms "up" and "high" and their related forms refer to a direction towards the top 14 of the core 12. It is preferable for no part of the wick 18 to be lower than any particle of the combustible material 24. However, even if there is some overlap of the combustible material 24 and the wick 18, the product will still operate in accordance with and have the advantages of the invention. A small amount of overlap is permitted, in part because the liquid pool of fuel which forms when the candle burns is somewhat bowl-shaped and thus a particle of combustible material 24 which is slightly higher than a portion of the wick 18 will still not fall into the liquid pool of fuel. Thus, the wick 18 must extend downwardly no further than substantially the selected level.

Figure 3:
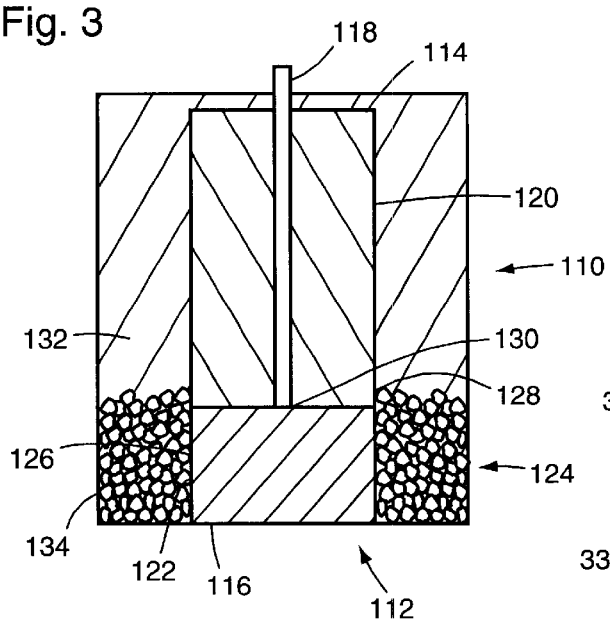
FIG. 3 is a cross-sectional view of a second embodiment of the candle of the present invention.

The lower end 30 of the wick 18 may take a variety of positions with respect to the selected level 28 and the combustible material. As shown in FIG. 1, the lower end 30 of the wick 18 terminates above the selected level 28. The length L of the wick 18 may be even smaller and the lower end 30 of the wick 18 may be even further above the selected level 28. Alternatively, in a second embodiment of the candle 110, shown most clearly in FIG. 3, the lower end 130 of the wick 118 terminates substantially at the selected level 128. In all other ways, the second embodiment of the candle 110 is identical to the first embodiment of the candle 10. FIG. 3 shows that terminating substantially at the selected level 128 includes terminating slightly lower than the selected level 128.

Figure 2:
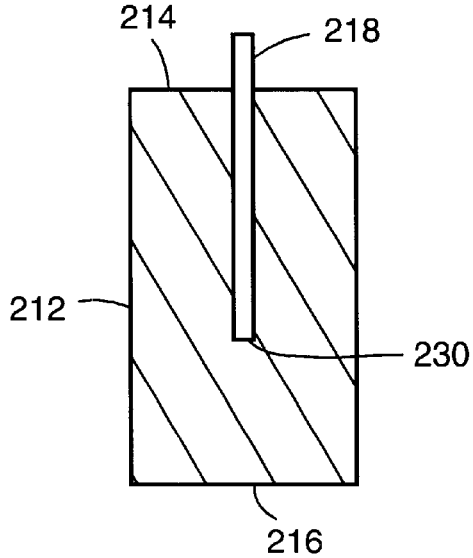
FIG. 2 is a cross-sectional view of a second embodiment of the core of the present invention.

Turning now to FIG. 2, an alternative embodiment of the core is shown. FIG. 2 shows a short-wicked candle 212. A short-wicked candle, generally speaking, is a candle formed by placing a wick only part of the way down the candle. The wick 218 extends from the top 214 of the core 212 towards the bottom 216 of the core 212 but does not reach the bottom 212 of the core 216. Thus, in this embodiment of the core 212, the candle 20 and riser 22 of the first embodiment of the core 12 are formed in one piece. Either of the embodiments of the core 12, 212 and the various possible modifications may be used in any of the later FIGS. However, only the first embodiment of the core 12 is shown throughout FIGS. 3–9.

Returning to FIG. 1, the candle 10 also includes a fill composition 32. The fill composition 32 is interspersed around the combustible material 24 and secures the combustible material 24 to the core 12. The fill composition 32 can only be truly interspersed around the combustible material 24 if the combustible material 24 is a particulate matter, as is shown in the FIGS. However, the combustible material 24 can be a number of types of materials including a solid ring of paper or the like. In such a case, the term "interspersed around" means at least partially surrounding, because a primary purpose of interspersing the fill composition 32 and combustible material 24 is to secure the combustible material 24 to the core 12. Another primary purpose of interspersing the fill composition 32 around the combustible material 24 is to secure the particles of the combustible material 24 to each other. The fill composition 32 may surround more than the lower part 30 of the core 12 and may surround the core 12 and cover the top 14 of the core 12.

There are a variety of preferred materials and preferred spacing arrangements in the present invention. The core 12 and the fill composition 32 are preferably made of fuels which are solid at room temperature, but which melt when the wick 18 is lit. The core 12 and fill composition 32 are preferably made of the same fuel, most preferably wax. The combustible material 24 is preferably a particulate matter, such as potpourri, candy, leaves, or the like. Most preferably, the combustible material 24 is coffee beans or cinnamon strips. The selected level 28 is preferably spaced from the bottom 16 of the core 12 by between about 1 inch and about 4 inches. The mixture formed when the fill composition 32 is interspersed around the combustible material 24 is referred to as the fill composition and combustible material interspersion 34. The fill composition and combustible material interspersion 34 preferably has a width W between about ¼ inch and about 2 inches.

Figure 4:
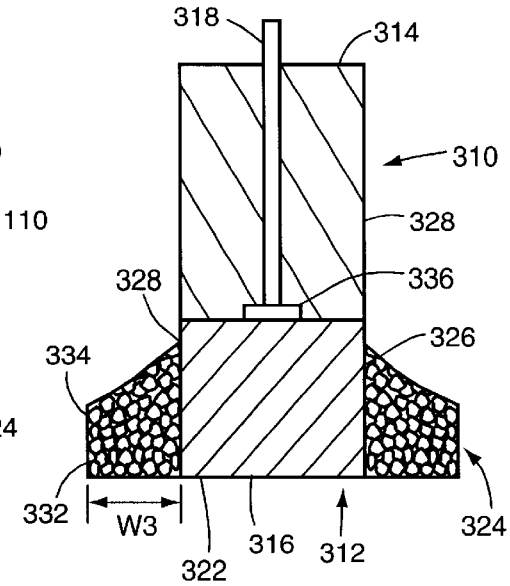
FIG. 4 is a cross-sectional view of a third embodiment of the candle of the present invention.
Figure 5:
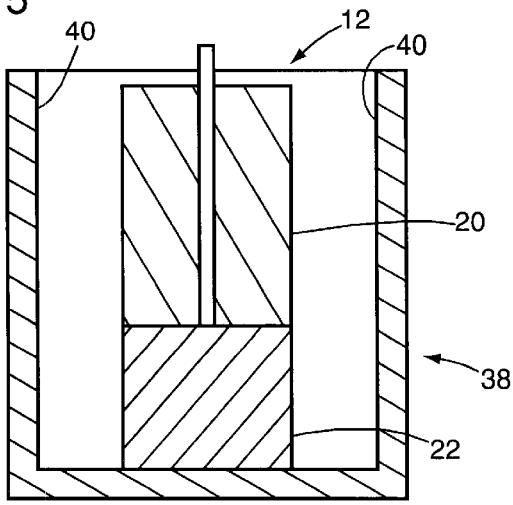
FIG. 5 is a cross-sectional view of a core in a mold.

A variety of other possible modifications to portions of the present invention are shown in FIG. 4. Any of these modifications can be made individually to any of the embodiments mentioned above. As shown in FIG. 4, the fill composition 332 may surround only a portion of the core 312 to form a protruding base. If the width W3 of the fill composition and combustible material interspersion 334 is small enough, the difference may not be noticeable.

There may also be included a wick sustainer 336 to be used as a base for retaining the wick. The wick sustainer 336 can also operate to separate the wick 318 from the riser 322. A sheet of non-flammable material, such as an aluminum foil, can also be interposed between the wick and the riser 322 to provide a barrier separating the riser portion of the core from the candle portion of the core. The wick sustainer 336 may be a non-flammable material, and its base may extend radially outwardly to serve as the barrier.

Figure 10:
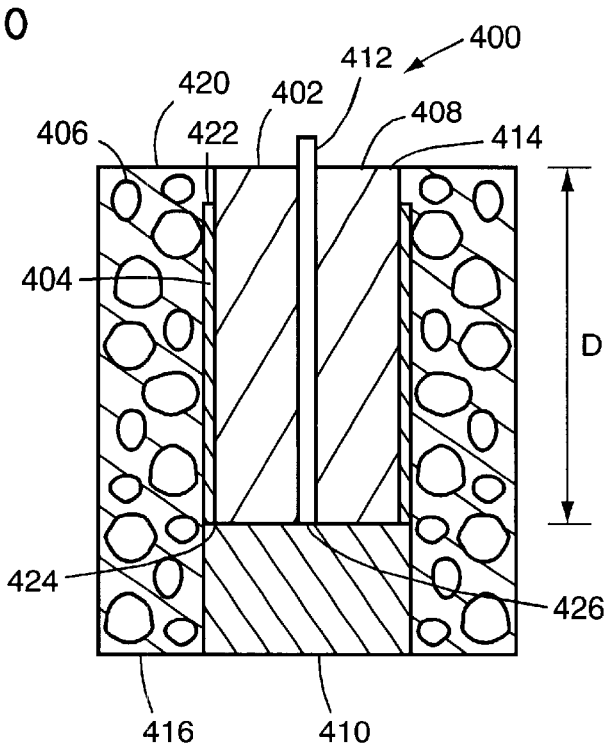
FIG. 10 is a cross-sectional view of a fourth embodiment of the candle of the present invention.
Figure 11:
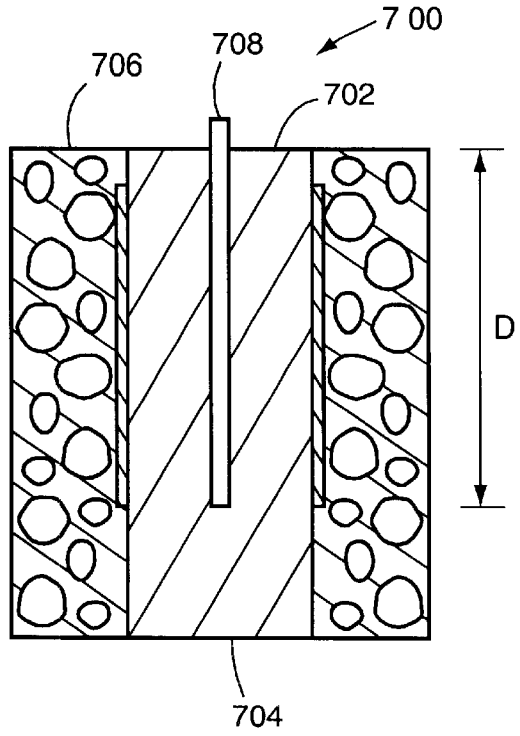
FIG. 11 is a cross-sectional view of a fifth embodiment of the candle of the present invention.

Turning now to FIGS. 10 and 11, there is shown yet another alternative embodiment to those described above. Turning first to FIG. 10, which is the more preferred configuration, the candle 400 includes a fuel core 402, a protective sleeve 404, and a combustible material 406.

The fuel core 402 is preferably formed of first and second portions, and most preferably is a candle 408 atop a riser 410. In the preferred embodiment, the riser 410 is a block of fuel, preferably wax. However, many alternatives to the block of fuel are possible, as described above. For example, a non-flammable solid, such as a metal, ceramic or glass block, can be used in the place of the block of wax. In this embodiment, it is preferred that the riser 410 be slightly larger in diameter or width than the candle 408.

A protective sleeve 404 substantially surrounds the candle 408. The riser 410 is preferably sufficiently larger than the candle 408 that the protective sleeve 404 rests on the riser 410. The sleeve 404 is preferably translucent and is most preferably made of PVC.

A combustible material 406 surrounds at least a portion of the protective sleeve 404. A fill composition 420 may be interspersed with the combustible material 406, surrounding at least a portion of the sleeve 404 and securing the combustible material 406 to the sleeve 404. The configuration of the combustible material 406 and the fill composition 420 is similar to that disclosed in connection with the previously described embodiments. In an alternative embodiment, the fill composition need not be used to secure the combustible material 406 to the sleeve 404, if the core 402, sleeve 404, and combustible material 406 are all enclosed within a glass jar or other transparent container. In such a case, the exterior container would hold the combustible material 406 near to the sleeve 404 and core 402, and render the fill composition 420 unnecessary. However, the use of the fill composition 420 is preferred. It is also preferred, for aesthetic reasons, that a thin layer of the fill composition 420 cover the end 422 of the sleeve 404 which is closest to the top surface 414 of the candle 400.

The candle 408 includes a wick 412. The wick 412 extends a selected distance D from the top surface 414 of the candle 408 towards the bottom 416 of the candle 400. The protective sleeve 404 extends the selected distance D in surrounding relationship to the candle 408 substantially from the top surface 414 of the candle 408 towards the bottom 416 of the candle 400. The sleeve 404 may extend a slightly greater or lesser distance than the selected distance D. A purpose of the sleeve 404 is to separate the combustible material 406 from the core 402, thereby minimizing the risk of the combustible material 406 falling into a molten pool of fuel and nearing the wick 412 to become a secondary wick. The sleeve 404 should extend substantially the same selected distance as the wick 412 from the top surface 414 of the candle 408, and therefore the sleeve 404 extends substantially the selected distance from the top surface 414 of the candle 408 in surrounding relationship to the core 402. However, the wick 412 and sleeve 404 need not extend an identical distance to achieve the desirable result. One end 422 of the sleeve 404 need not be coplanar the top surface 414 of the candle 408, and that configuration is not preferred, since viewing the end 422 of the sleeve 404 is not aesthetically pleasing. The other end 424 of the sleeve 404 need not be coplanar with the end 426 of the wick 412, because the liquid pool of fuel which forms when the core 402 burns is somewhat bowl-shaped and thus a sleeve 404 which terminates slightly above the end 426 of the wick 412 still achieves the desired result.

Turning now to FIG. 11, a similar candle 700 is shown. In this configuration, however, the core 702 is a short-wicked candle 704. Because a short-wicked candle 704 usually has the same diameter throughout its length, the sleeve 706 cannot rest on any other portion of the core as shown in FIG. 10. As a result, it is important in this embodiment that the interior diameter of the sleeve 706 be very close to the diameter of the core 702, so that the sleeve 706 remains appropriately positioned with respect to the wick 708. Because the wick 708 and the sleeve 706 extend substantially the same distance and because the sleeve 706 is designed to surround the portion of the core 702 which includes the wick 708, the close fit between the core 502 and sleeve 706 serves to maintain the proper relationship between the sleeve 706 and wick 708 during the remainder of the assembling process.

A first embodiment of the method of making the candle 10 is shown in FIGS. 5–9. As most clearly seen in FIG. 5, the core 12 is placed in the mold 38. The core 12 is spaced from the sides 40 of the mold 38, as is most clearly shown in FIG. 9. Since the mold 38 is shown as being a circular cylinder, there is only one surrounding side 40. Thus, the term "sides 40" includes the singular as well as the plural. The step of placing the core 12 in the mold 38 may include a number of steps. The placing step may include placing a riser 22 in the mold 38, then placing a candle 20 on the riser 22. Alternatively, the placing step may include placing a short-wicked candle 212 in the mold 38.

Figure 6:
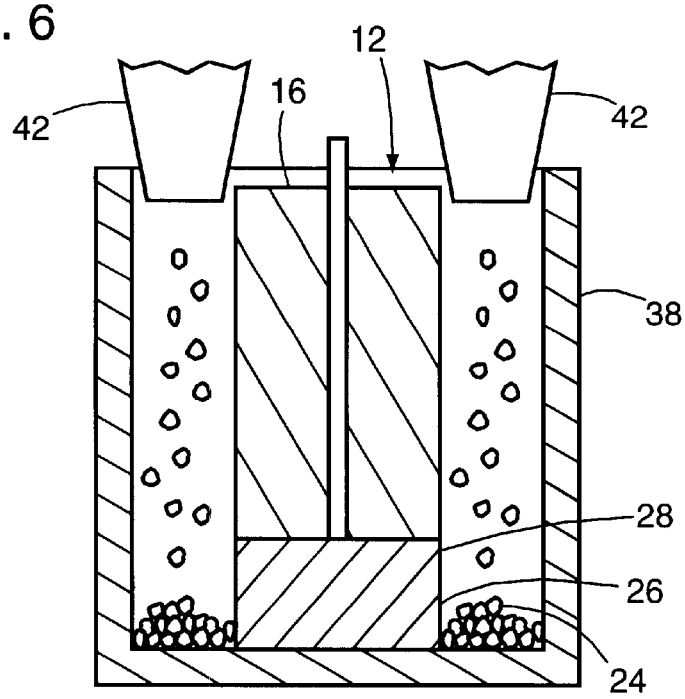
FIG. 6 is a cross-sectional view of a core in a mold being surrounded by a combustible material.

Next, the lower part 26 of the core 12 is surrounded with a combustible material 24 up to a selected level 28. As stated earlier in the disclosure, the wick 18 is surrounded by the core 12 and extends downwardly from the top 16 of the core 12 no further than substantially the selected level 28. As shown in FIG. 6, the combustible material 24 may be introduced into the mold 38 through a spout 42. The spout 42 is representative of any of the ways known in the art, such as a funnel, for introducing the combustible material 24 into the mold 38 to surround the core 12. Any of the ways known in the art are acceptable and a person of ordinary skill in the art can easily select the most appropriate method or apparatus for this step based on the particular particle size of the combustible material 24.

Figure 7:
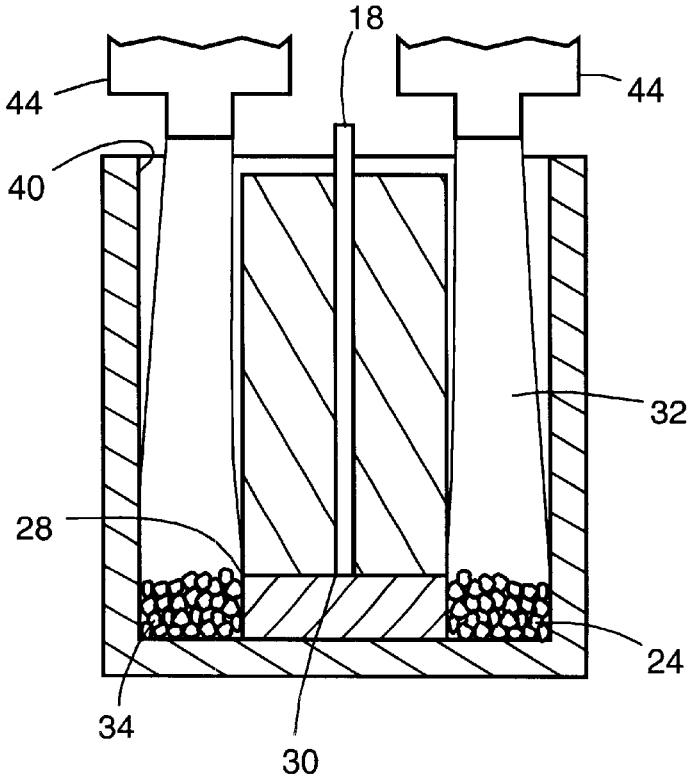
FIG. 7 is a cross-sectional view of a core in a mold, the fill composition being interspersed with the combustible material which surrounds the core.

As seen in FIG. 7, a fill composition 32 is poured into the mold 38 between the sides 40 of the mold 38 and the core 12. The fill composition 32 intersperses around the combustible material 24 and forms a wall surrounding the core. FIG. 7 shows the fill composition 32 as being introduced into the mold 38 through spouts 44. The spouts 44 are representative of any of the ways known in the art for introducing the fill composition 32 into the mold 38 to surround at least the lower part 26 of the core 12. Any of the ways known in the art is acceptable and a person of ordinary skill in the art can easily select the most appropriate method or apparatus for this step based on the particular properties of the fill composition 32, such as melt temperature, viscosity, and the like. The term "pour" is used for the introduction of the fill composition 32 into the mold 38 because ordinarily, the fill composition 32 will be introduced into the mold in a liquid form. The term pour is intended to encompass any method of introducing a fill composition 32 into the mold in a liquid or other fluent form. It is important that the fill composition 32 be fluent because otherwise, the fill composition 32 will not intersperse around the combustible material 24. The fill composition and combustible material interspersion 34 can be separately formed and inserted into the mold 38 to surround the core 12. The fill composition 32 is preferably the same candle fuel from which the core 12 is made so that a uniform exterior color and texture are maintained. However, the fill composition 32 may be other types of materials, such as silicon, a flour and water mixture, a glue, or another type of binder. Of primary importance are that the fill composition 32 be sufficiently transparent to permit a viewer to see the decorative combustible material 24 and that the fill composition 32 be capable of securing the pieces of combustible material 24 to the core 12 and to the other pieces of combustible material 24.

The pouring step may alternatively include introducing the fill composition 32 in pellet form into the mold 38 to surround the core 12. If a pellet form is used, then the mold 38 must be heated in order to melt the pellets of fill composition 32 prior to removing the candle 10 from the mold 38, or the pellets of fill composition 32 and the combustible material 24 would not remain attached to the core 12. If the pellet form of the fill composition 32 is desired and it is not possible or preferred by a maker to heat the mold 38, a container (not shown) may be inserted in the mold to retain the core 12, the combustible material 24, and the pellets of fill composition 32 in relative position to form a container candle. This configuration is not preferred.

Figure 8:
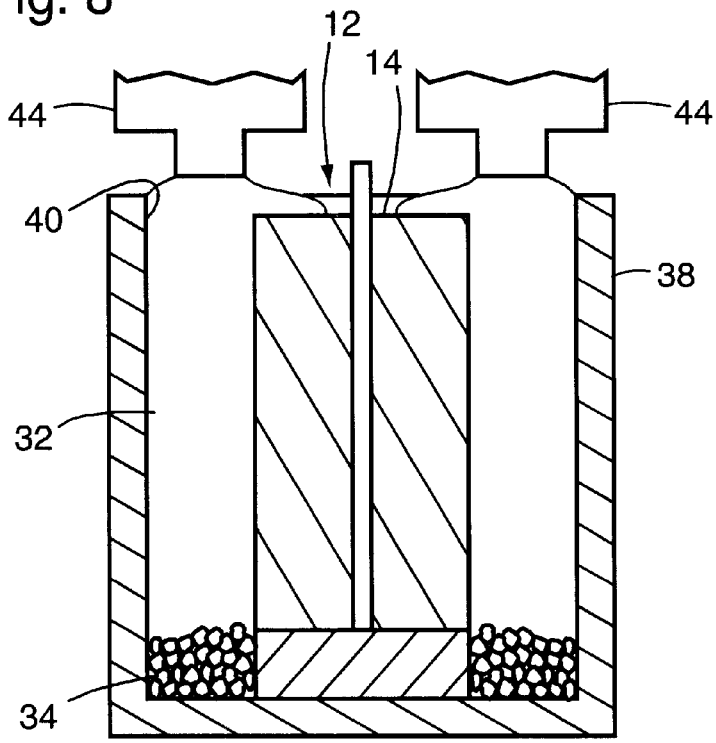
FIG. 8 is a cross-sectional view of a core in a mold, the fill composition being poured to cover the top of the core.
Figure 9:
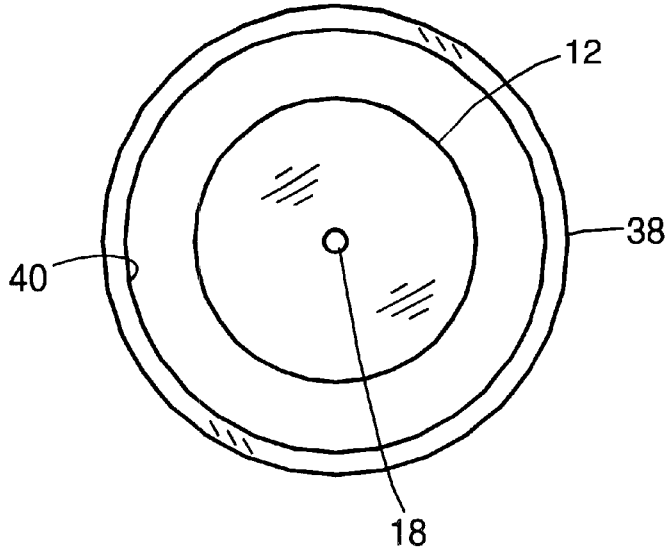
FIG. 9 is a top view of the core in the mold as shown in FIG. 5.

There is no restriction as to the height to which the fill composition 32 may be poured, except that it should not be poured to overflow the mold 38 or completely submerge the wick 18. The fill composition 32 may be poured so that it surrounds the core 12 and covers the top 14 of the core 12 to provide a uniform outer surface, as is best shown in FIG. 8, in which case, it is most preferred that the fill composition 32 be the same fuel from which the fuel core 12 is made, for aesthetic reasons.

There are alternative systems for the placing of a riser 22 in the mold 38, as mentioned in connection with the description of the candle 10. Instead of placing a riser 22 in the mold 38 and then placing a candle 20 atop the riser 22, the combustible material 24 and the fill composition 32 may be poured into the mold 38 only up to a selected level 28 to form a cylindrical disk extending between the sides 40 of the mold 38. A candle 20 may then be placed on the solidified fill composition and combustible material interspersion 34. Alternatively, the riser 22 can be formed in situ by suspending the candle 20 by its wick 18 in the mold 38 and pouring the combustible material into the mold to fill the area under the suspended candle 20, referred to as underpouring. Additional fill composition 32 can then be poured around the candle 20 or around and under the candle 20, depending on the precise method used.

A similar method is used to make the candle 400 of FIGS. 10 and 11. As above, the fuel core 402 is placed in a mold which is sufficiently larger than the core 402 that the core 402 is spaced from the sides of the mold. This placing step may include placing a riser 410 in the mold and placing a candle 408 atop the riser 410. Alternatively, this step may include placing a short-wicked candle 502 in the mold. The fuel core 402 includes a wick 412 which extends a selected distance D from the top surface 414 of the core 402.

The fuel core 402 is surrounded with a protective sleeve 404 which substantially extends the selected distance D from the top surface of the core 402. The sleeve 404 may be placed in surrounding relationship to the core 402 before the core 402 is placed in the mold. Alternatively, the core 402 may be placed in the mold and then the sleeve 404 placed in the mold in surrounding relationship to the core 402.

A combustible material 406 is then placed in the mold to surround at least a portion of the sleeve 404. The combustible material 406 need not surround the entirety of the sleeve 404. In the preferred embodiment, a fill composition 420 is then poured into the mold between the sides of the mold and the core 402 to intersperse the fill composition 420 around the combustible material 406 as in the above-described embodiment. The mold in this embodiment may take the form of a translucent container into which the core 402, sleeve 404, and combustible material 406 are placed and which is sold as part of the candle. If such a container is used, no fill composition 420 is necessary to maintain the candle 400 intact. However, it is preferable that a cover layer be placed over the combustible material 406 between the sleeve 404 and the surrounding container to retain the combustible material 406 in the container or jar in order to minimize the probability of the combustible material 406 becoming dislodged and falling into the area of the core 402 if the candle 400 is jostled or moved.

Figure 18:
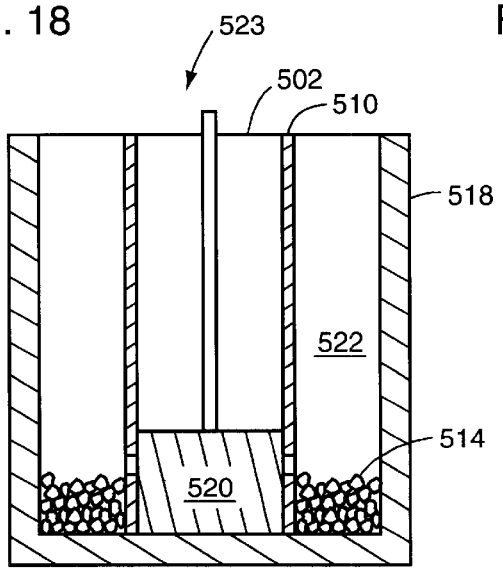
FIG. 18 is cross-sectional view of a fuel core within a sleeve in a mold, the sleeve being partially surrounded by a combustible material, according to an alternative embodiment to the embodiment shown in FIG. 12.
Figure 19:
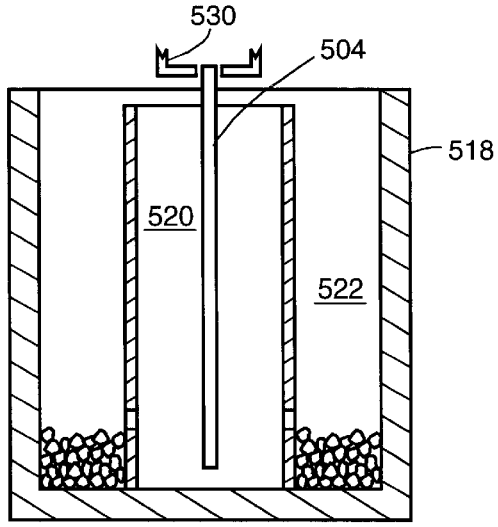
FIG. 19 is a cross-sectional view of a wick within a sleeve in a mold, the sleeve being partially surrounded by a combustible material, according to a second alternative embodiment to the embodiment shown in FIG. 12.
Figure 20:
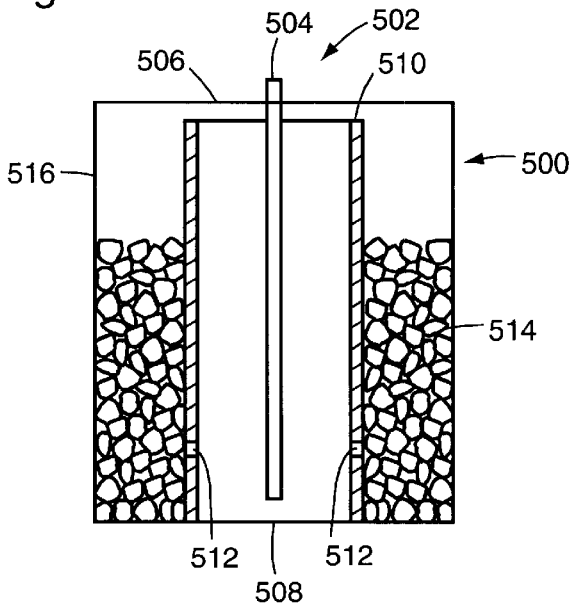
FIG. 20 is a cross-sectional view of the preferred configuration of a candle resulting from one of the methods shown in FIGS. 12–19.

Yet another candle configuration and method of making that candle are shown in FIGS. 12–20. FIG. 20 illustrates the completed candle 500. The candle 500 has a fuel core 502. A wick 504 protrudes from the top surface 506 of the fuel core 502 and extends from the top surface 506 substantially to the bottom surface 508 of the fuel core 502. The fuel core 502 is substantially surrounded by a sleeve 510 which extends from about the top surface 506 of the fuel core 502 to about the bottom surface 508 of the fuel core 502. The sleeve 510 is preferably translucent. A plurality of holes 512 are formed through the sleeve 510. A combustible material 514 surrounds at least a portion of the sleeve 510. A fill composition 516 is interspersed around the combustible material 514.

This configuration prevents the combustible material 514 from coming into contact with a lighted wick 504 and catching on fire. The holes 512 are configured to have a size and shape which makes them impassable to the particles of the combustible material 514. Because the combustible material 514 cannot pass through the holes 512, the combustible material 514 cannot contact the wick. As a result, the combustible material 514 can be filled to a level above the bottom of the wick 504 since the risk of fire is minimized by the presence of a flame barrier formed by the sleeve. The holes 512 are used in the method of making the candle 500, and this method is shown in FIGS. 12–19.

Figure 12:
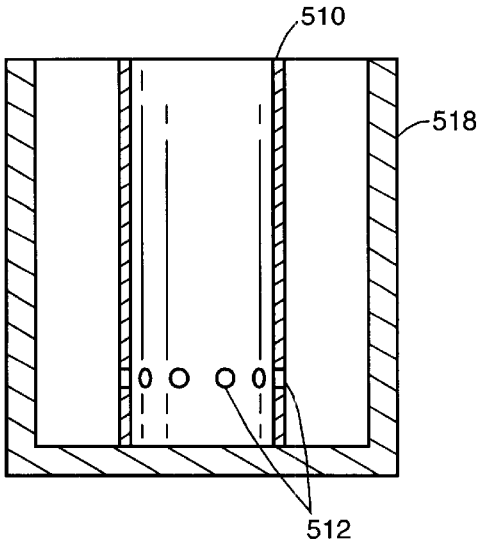
FIG. 12 is a cross-sectional view of a perforated sleeve in a mold according to an alternative embodiment of the present invention.
Figure 13:
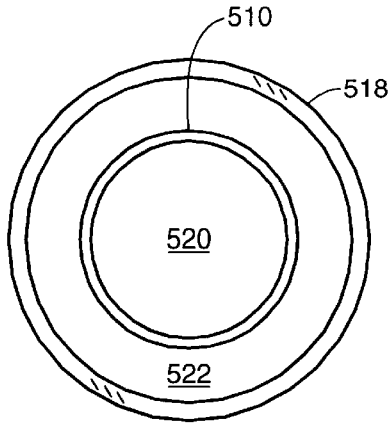
FIG. 13 is a top view of the sleeve and mold according to the embodiment shown in FIG. 12.
Figure 14:
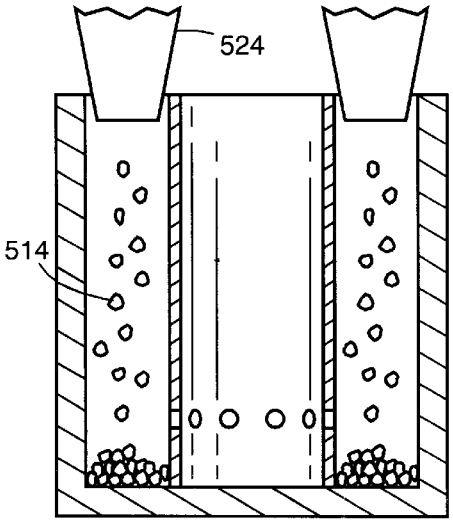
FIG. 14 is a cross-sectional view of the sleeve in the mold being surrounded by a combustible material according to the embodiment shown in FIG. 12.
Figure 15:
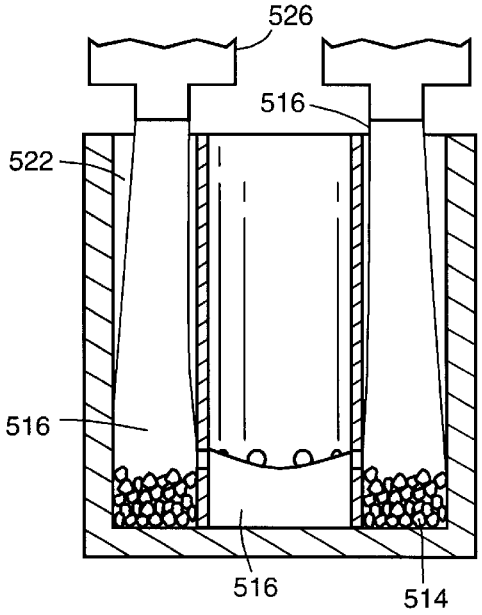
FIG. 15 is a cross-sectional view of the sleeve in the mold, the fill composition being interspersed with the combustible material which surrounds the sleeve and passing through holes in the sleeve to partially fill a portion of the mold within the sleeve according to the embodiment shown in FIG. 12.
Figure 16:
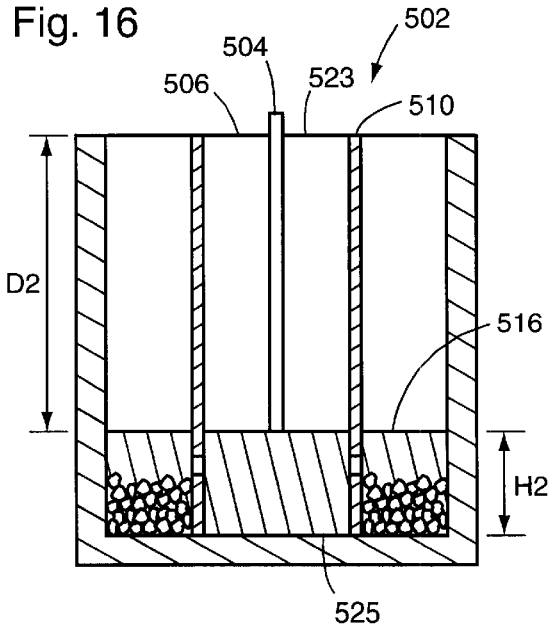
FIG. 16 is a cross-sectional view of a fuel core within the sleeve atop the fill composition according to the embodiment shown in FIG. 12.
Figure 17:
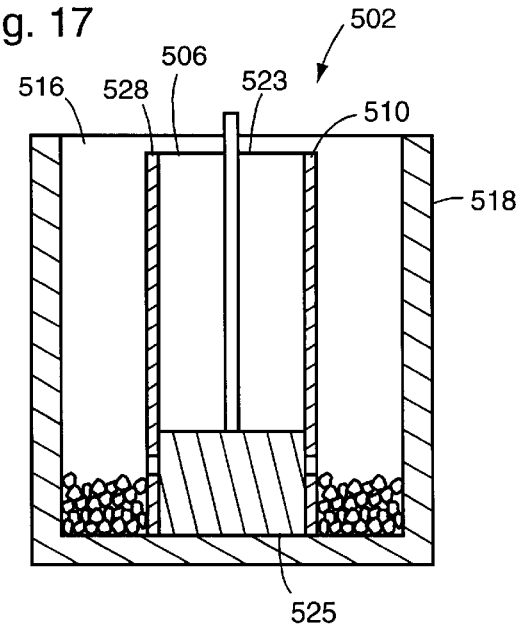
FIG. 17 is a cross-sectional view of a candle in a mold according to the embodiment shown in FIG. 12.

As shown in FIGS. 12–13, the sleeve 510, which includes a plurality of holes 512, is placed in a mold 518. This divides the mold into an inner portion 520 and an outer portion 522. These portions 520, 522 are generally concentric. As shown in FIG. 14, the combustible material 514 is then poured into the outer portion 522 using conventional pouring apparatus 524 as mentioned above in connection with a previously-described embodiment. Then, as shown in FIG. 15, the fill composition S16 is poured into the outer portion 522 using a conventional pouring apparatus 526 as described above in connection with a previously-described embodiment. The fill composition 516 becomes interspersed around the combustible material 514. Once the level of the fill composition 516 in the outer portion 522 has risen to the height of the holes 512 in the sleeve 510, some of the fill composition 516 passes through the holes 512 and begins to fill the inner portion 520. As shown in FIG. 16, the fill composition 516 partially fills each portion 520, 522 and each portion 520, 522 is filled equally to the same height Hi. This fill composition 516 is then allowed to solidify and a core candle 523 is then placed in the inner portion 520 within the sleeve 510. The core candle 523 includes a wick 504 which, upon insertion, extends only a selected distance D1 from the top surface 506 of the fuel core 502. The fuel core 502 in this embodiment includes the core candle 523 and the riser 525 formed by the fill composition 516 in the inner portion 520 of the mold. An additional quantity of the fill composition 516 is then poured into the outer portion 522 and at least substantially fills the outer portion 522 of the mold 518. As mentioned above in connection with a previously-described embodiment, the fill composition 516 should not overflow the mold 518, but may cover the top 506 of the fuel core 502 and the top 528 of the sleeve 510 for aesthetic reasons, as best seen in FIG. 17. The fill composition 516 is then allowed to solidify and the resulting candle 500 is then removed from the mold 518.

One alternative method, which involves underpouring, is illustrated in FIG. 18. The core candle 523 may be placed within the sleeve 510 before the fill composition 516 is poured. The core candle 523 may be inserted either before or after the pouring of the combustible material 514 and before or after the insertion of the sleeve 510 into the mold 518. The fill composition 516 can then be poured into the outer portion 522 in the same way as mentioned above. The fill composition 516 partially fills the inner portion 520 under the core candle 523 and substantially fills the outer portion 522, also becoming interspersed around the combustible material 514. If this method is to be used, it is preferred that the core candle 523 and the sleeve 510 have a close fit relationship so that upward pressure on the core candle 523 from the fill composition 516 being poured to form a riser portion of the fuel core 502 does not move the core candle 523 upwardly. In all other respects, this method is the same as that described in connection with FIGS. 12–17.

A second alternative embodiment is shown in FIG. 19. In this embodiment, a wick 504 is suspended in the inner portion 520 of the mold 518 using a conventional suspending apparatus 530. The wick 504 may extend any distance in the inner portion 520 of the mold 518. After the sleeve 510 and combustible material 514 have been placed in the mold 518, a fill composition is then poured into the mold 518 and substantially fills each portion 520, 522. In this embodiment, it is necessary that the fill composition 516 be a fuel suitable for burning in a candle, since the fill composition 516 will form the fuel core 502. In addition, it is preferred in this embodiment that fill composition 516 be poured into the inner portion 502 in order to accommodate the wick 504. In all other ways, this method is the same as that shown in FIGS. 12–17.

FIGS. 12–19 show the holes 512 as appearing near the bottom 508 of the sleeve 510. It is preferred that the holes 512 be near the bottom 508 of the sleeve 510 because such positioning enables underpouring up to a selected level. However, the holes 512 could be placed higher and they can be notched in the bottom of the sleeve. If a core candle 523 is to be inserted, as in FIGS. 12–18, the holes 512 must not be placed so far from the bottom 508 that the core candle 523 blocks or otherwise prevents passage of the fill composition 516 through the holes 512. When a sleeve having holes in it extends the entire length of the candle, the decorative combustible materials may fill the entire outer portion 522 because the sleeve prevents their ignition by the candle flame.

Figure 21:
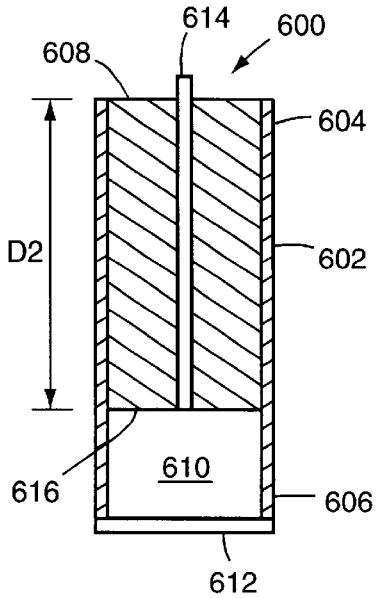
FIG. 21 is a cross-sectional view of yet another embodiment of the present invention.
Figure 22:
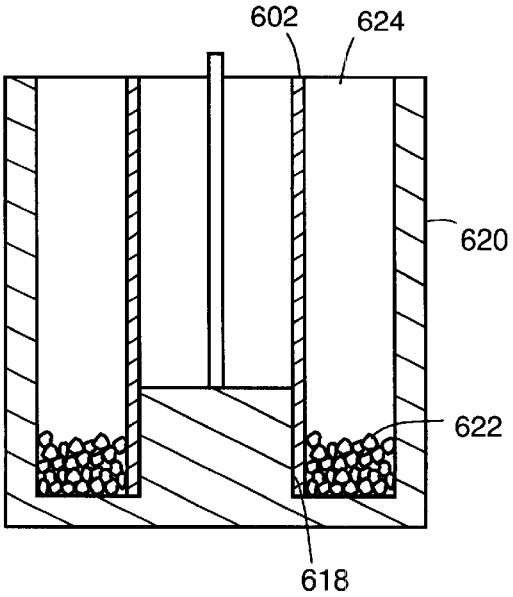
FIG. 22 is a cross-sectional view of a sleeve, fuel core, and combustible material in a mold according to the embodiment of FIG. 21.
Figure 23:
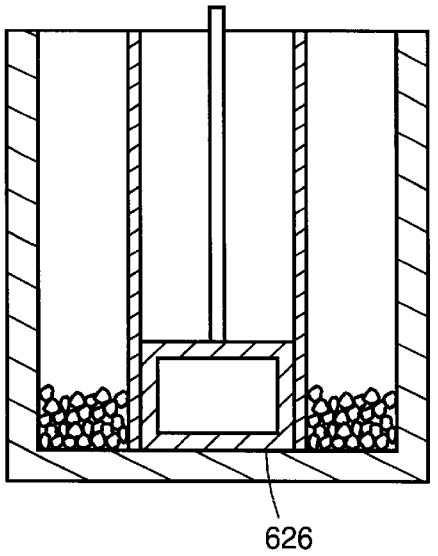
FIG. 23 is a cross-sectional view of a sleeve, fuel core, and combustible material according to a first alternative embodiment of the embodiment of FIG. 21.

Yet another embodiment of a candle 600 is shown in FIGS. 21–23. This embodiment has a sleeve 602 which has a top 604 and a bottom 606. The sleeve 602 substantially surrounds a fuel core 608 which extends a selected distance D2 from the top 604 of the sleeve 602. The selected distance D2 is spaced from the bottom 606 of the sleeve 602. This forms a cavity 610. It is preferred that a base 612 adjacent the bottom 606 of the sleeve 602 be included so that molten fuel will not flow out of the candle 600 when the wick 614 burns down near the bottom 616 of the fuel core 608. The cavity 610 is preferably filled with a fluid, such as air or water.

As shown in FIG. 22, this embodiment of the candle 600 may be molded in a way similar to that shown in FIGS. 12–19. A raised portion 618 may be incorporated into the mold 620 if it is desired to mold the fuel core 608 at the same time as the combustible material 622 and fill composition 624 are poured to surround the sleeve 602, similar to the way shown in FIG. 19. However, as an alternative, the fuel core 608 may be inserted within the sleeve 602 and both placed in a mold without the raised portion. The use of such a method requires a close fit relationship between the fuel core 608 and the sleeve 602 to maintain the fuel core 608 in an appropriate position.

As shown in FIG. 23, the cavity may be at least partially filled with a non-flammable solid. The cavity 610 may be filled with a hollow block 626, as shown. Alternatively, the cavity 610 may be filled with a solid block or merely a pedestal. The preferred non-flammable solids include glass and ceramic.

While certain preferred embodiments of the present invention have been disclosed in detail, it is to be understood that various modifications may be adopted without departing from the spirit of the invention or scope of the following claims.

What is claimed is:

1. A candle, comprising:

(a) a fuel core including a wick which extends through the fuel core a selected distance from a top surface of the fuel core;

(b) a separating protective sleeve substantially extending and surrounding the fuel core at least the selected distance from the top surface of the fuel core; and (c) a decorative, particulate combustible material exteriorly surrounding at least a portion of the sleeve, and separated from a molten pool of fuel, and interspersed in a candle fuel fill composition surrounding at least a portion of the sleeve and securing the combustible material to the sleeve.

2. The candle according to claim 1, wherein the fuel core is a candle atop a riser.

3. The candle according to claim 2, wherein the riser is a block of wax.

4. The candle according to claim 2, wherein the riser is made of glass.

5. The candle according to claim 2, wherein the riser is made of ceramic.

6. The candle according to claim 2, wherein the sleeve rests atop the riser.

7. The candle according to claim 1, wherein the sleeve is translucent.

8. A method of making a candle, comprising:

(a) placing a fuel core in a mold, the mold being sufficiently larger than the fuel core that the fuel core is spaced from sides of the mold, the fuel core including a wick which extends into the fuel core from a top surface of the fuel core to a selected level;

(b) substantially surrounding the fuel core with a separating protective sleeve extending substantially the selected distance from the top surface of the core;

(c) pouring a decorative, particulate combustible material into the mold exteriorly of the sleeve, and (d) pouring a candle fuel fill composition into the mold between the sides of the mold and the core to intersperse the fill composition around the combustible material and secure the combustible material to the sleeve, and removing the candle from the mold.

9. The method of making a candle, according to claim 8, wherein the step of placing the fuel core in the mold comprises placing a short-wicked candle in the mold.

10. The method of making a candle, according to claim 8, wherein the step of placing the fuel core in the mold comprises placing a riser in the mold and placing a candle atop the riser.

11. A method of making a candle, comprising:

(a) placing a sleeve in a mold, the sleeve being smaller than the mold thereby separating the mold into inner and outer generally concentric portions, the sleeve having a plurality of holes therethrough;

(b) pouring a decorative, particulate combustible material into at least the outer portion, the combustible material being too large to pass through the holes in the sleeve; and (c) pouring a fill composition into at least one of the portions of the mold, the fill composition passing through the holes in the sleeve and at least partially filling each of the portions.

12. A method of making a candle according to claim 11, further comprising suspending a wick in the inner portion of the mold.

13. A method of making a candle according to claim 12, wherein the fill composition is poured into the inner portion of the mold.

14. A method of making a candle according to claim 11, wherein the fill composition substantially fills each of the portions.

15. A method of making a candle according to claim 11, further comprising placing a core candle within the sleeve before pouring the fill composition.

16. A method of making a candle according to claim 15, wherein the fill composition is poured into the outer portion of the mold, partially filling the inner portion of the mold and substantially filling the outer portion of the mold.

17. A method of making a candle according to claim 11, further comprising placing a core candle in the inner portion of the mold after the fill composition partially fills the inner portion of the mold.

18. A method of making a candle according to claim 17, further comprising pouring an additional quantity of the fill composition into the outer portion of the mold after placing the core candle in the inner portion of the mold.

19. A candle, comprising:

(a) a fuel core including a wick extending longitudinally into the core at least a selected distance from a top surface of the fuel core;

(b) a decorative particulate combustible material exteriorly surrounding and spaced from at least a portion of the fuel core;

(c) a protective sleeve disposed between the fuel core and the particulate combustible material preventing the combustible material from entering a molten pool of fuel created during burning of the wick and being combusted by the burning wick, and (d) a candle fuel fill composition surrounding at least a portion of the sleeve and securing the combustible material to the sleeve.

* * * * *